United States Patent [19]

Giordano

[11] Patent Number: 4,848,243

[45] Date of Patent: Jul. 18, 1989

[54] DRAWING TABLE CONSTRUCTION

[76] Inventor: John M. Giordano, 770 Lynnhaven Pkwy., Virginia Beach, Va. 23452

[21] Appl. No.: 144,671

[22] Filed: Jan. 12, 1988

Related U.S. Application Data

[63] Continuation of Ser. No. 852,791, Apr. 21, 1986, abandoned.

[51] Int. Cl.[4] ..... A47F 5/12

[52] U.S. Cl. ..... 108/9; 248/455

[58] Field of Search ..... 108/9, 6, 1, 25, 26.2, 108/8; 150/52 R; 248/454, 455, 456, 461, 460; 33/1 AA, 443

[56] References Cited

U.S. PATENT DOCUMENTS

| | | | |
|---|---|---|---|
| 72,243 | 12/1867 | Tumy | 108/9 X |
| 383,117 | 5/1888 | Fitzgerald | 248/455 X |
| 742,347 | 10/1903 | Nevius | 108/9 |
| 1,390,938 | 9/1921 | Thompson | 248/456 |
| 1,457,889 | 6/1923 | Hinrichs | 108/9 |
| 1,953,527 | 4/1934 | Bentley | 248/456 |
| 2,328,471 | 8/1943 | Leffel | 108/9 X |
| 3,239,297 | 3/1966 | Bosko et al. | 108/9 X |
| 3,381,928 | 5/1968 | White | 108/9 X |
| 3,492,952 | 2/1970 | Yourist | 108/9 |
| 3,620,362 | 11/1971 | Valdes | 248/455 X |
| 3,682,109 | 8/1972 | Gordon | 108/9 |
| 3,901,360 | 8/1975 | Cook | 150/52 R X |
| 3,942,636 | 3/1976 | Matsuyama et al. | 150/52 R X |
| 4,421,943 | 12/1983 | Withjack | 248/455 X |
| 4,467,727 | 8/1984 | Strommer | 108/9 X |
| 4,592,285 | 6/1986 | Egli | 108/9 |

FOREIGN PATENT DOCUMENTS

| | | | |
|---|---|---|---|
| 7414 | of 1911 | United Kingdom | 108/9 |

*Primary Examiner*—Kenneth J. Dorner
*Assistant Examiner*—José V. Chen
*Attorney, Agent, or Firm*—Salter & Michaelson

[57] ABSTRACT

A drawing table construction includes a frame, a drawing board which is hingeably attached to the frame, a drawing board support assembly, an instrument tray and a pair of mounting arms which are attached to the frame for mounting the instrument tray in forwardly spaced relation to both the frame and the drawing board. The drawing board is securable in various different inclined positions relative to the frame with the support assembly; but since the instrument tray is attached to the frame rather than to the drawing board, it remains stationary when the drawing board is repositioned relative to the frame. The drawing board is also positionable in a collapsed position wherein it overlies the frame; and since the instrument tray is spaced forwardly from both the drawing board and the frame, it can be effectively utilized as a carrying handle for the drawing table when the drawing board is in the collapsed position.

10 Claims, 2 Drawing Sheets

DRAWING TABLE CONSTRUCTION

This is a continuation of application Ser. No. 06/852,791 filed Apr. 21, 1986 now abandoned.

BACKGROUND AND SUMMARY OF THE INVENTION

The instant invention relates to drafting equipment and more particularly to a drawing table construction which is adapted to be readily and easily transported.

A variety of different types of drafting and/or drawing table constructions have been heretofore available. In this regard the U.S. Pat. Nos. to CLOSTERMAN, 200,173; McANELLY, 783,973; ALFORD, 3,699,227; CRAWFORD, 3,954,314; RILEY et al, D-246,215; HOLDAM, JR., D-246,407; and ARNONE, D-256,869 disclose drawing tables and similar apparatus which are generally exemplary of the state of the art and which represent the closest prior art to the subject invention of which the applicant is aware. More specifically, the above patents generally teach drafting and/or drawing tables and similar apparatus which are adapted to be adjustably secured in various different inclined positions, as well as drafting and/or drawing apparatus which are adapted to be easily transported. They also teach portable drafting, and/or drawing boards which include compartments for containing instruments and/or supplies utilized by draftsmen or artists. However, they fail to suggest a simple drawing table construction which is adapted to be readily and easily transported in the manner of the drawing table of the instant invention and, which includes an instrument tray that is operative in the manner of the instrument tray of the drawing table of the instant invention, as will hereinafter be made apparent. Hence for these reasons as well as other reasons which will hereinafter be set forth, the above patents are believed to be of only general interest with respect to the drawing table construction of the instant invention.

The drawing table construction of the instant invention comprises a frame and a drawing board having front and rear edges which is hingeably attached to the frame so that it is hingeable between a collapsed position wherein the drawing board overlies the frame in substantially parallel relation and an inclined position wherein it extends upwardly and rearwardly from the frame. The drawing table construction further comprises means for releasably maintaining the drawing board in an inclined position, an instrument tray for receiving drafting instruments, and means securing the instrument tray to the frame in forwardly spaced relation to both the front edge of the drawing board and the front edge of the frame. The frame preferably comprises spaced front and rear frame members, a pair of spaced side frame members which extend between the front and rear frame members, and a bottom wall which extends between the front and rear frame members and the side frame members and cooperates therewith to define a compartment for receiving articles therein. In the preferred embodiment, the front edge portion of the drawing board is hingeably attached to the frame and it is constructed so that when the drawing board is in the collapsed position, it defines a cover for the compartment in the frame. Further, the tray and the front edge of the drawing board are preferably both substantially straight, and the tray is preferably mounted in substantially parallel spaced relation to the front edge of the drawing board. The means for releasably maintaining the drawing board in an inclined position is preferably hingeably attached to the drawing board so that it is engageable with the side frame members for releasably maintaining the drawing board in an inclined position, and it is preferably adjustable so that the drawing board can be secured in a plurality of different inclined positions wherein it extends upwardly and rearwardly from the frame. Still further, the drawing table is preferably constructed so that when the drawing board is in the collapsed position, the means for releasably maintaining the drawing board in an inclined position is interfitted in substantially aligned relation with the means for securing the instrument tray to the frame along the opposite side edges of the frame to provide substantially even side edges on the drawing table.

For use and operation of the drawing table construction of the instant invention, the frame is positioned on a supporting surface, and the drawing board is repositioned on the frame to a convenient upwardly and rearwardly inclined position. When the drawing board is in this position, the instrument tray is spaced forwardly from the forward edge of the drawing board and also forwardly from the frame; and since the instrument tray is attached to the frame rather than to the drawing board, it remains in an upwardly facing position so that instruments do not tend to fall out of the instrument tray when the drawing board is repositioned. The instrument tray also functions as a stop for preventing articles from falling off of the drawing board when the drawing board is in its upwardly inclined position. The compartment which is formed in the frame provides an effective area for storing and transporting drafting instruments and supplies; and when the drawing board is positioned in its collapsed position, the instrument tray, which is spaced forwardly from both the drawing board and the frame, provides an effective and convenient handle for carrying the drawing table.

Accordingly, it is a primary object of the instant invention to provide a light-weight and collapsible drawing table which is readily transportable.

Another object of the instant invention is to provide a colapsible drawing table having an instrument tray which can be utilized as a stop for retaining instruments or books on the table and which can also be utilized as a carrying handle.

An even further object of the instant invention is to provide a drawing table comprising a drawing board which is positionable in an inclined position and an instrument tray which remains stationary when the drawing board is moved to the inclined position thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
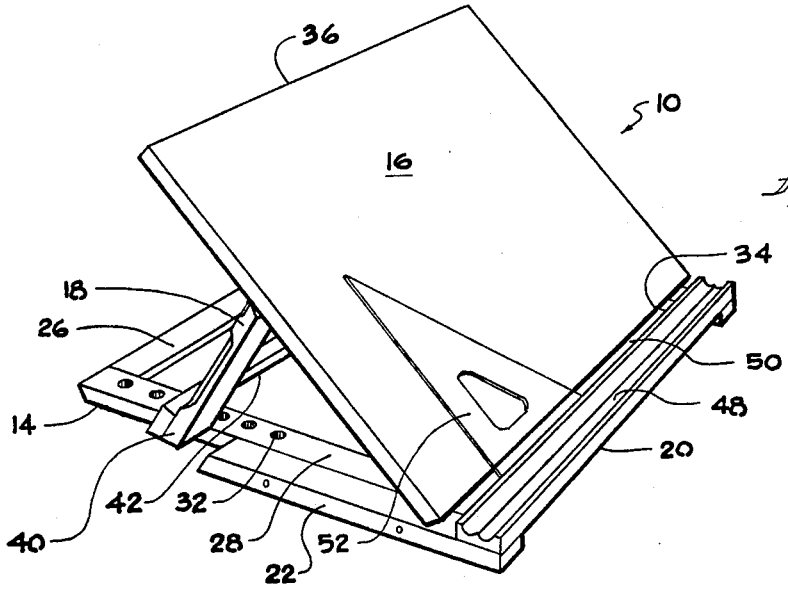
FIG. 1 is a front perspective view of the drawing table of the instant invention.
Figure 2:
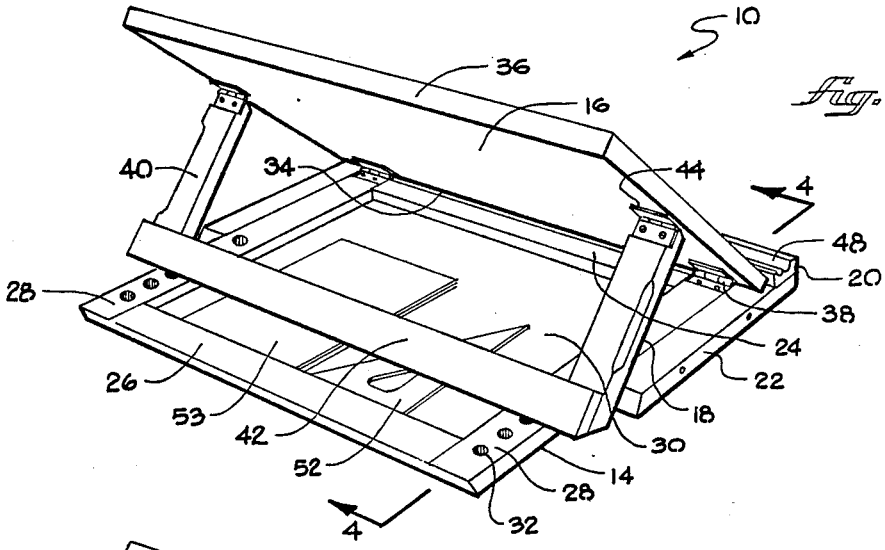
FIG. 2 is a rear perspective view thereof.
Figure 3:
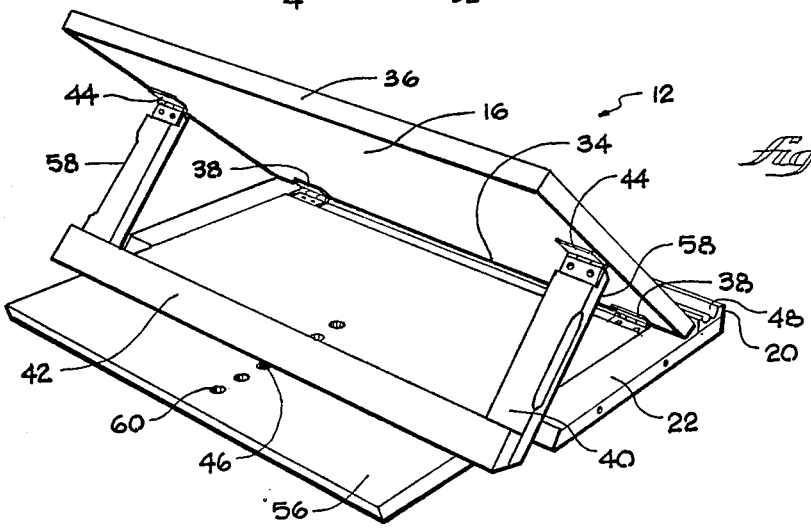
FIG. 3 is a rear perspective view of a second embodiment of the drawing table.
Figure 4:
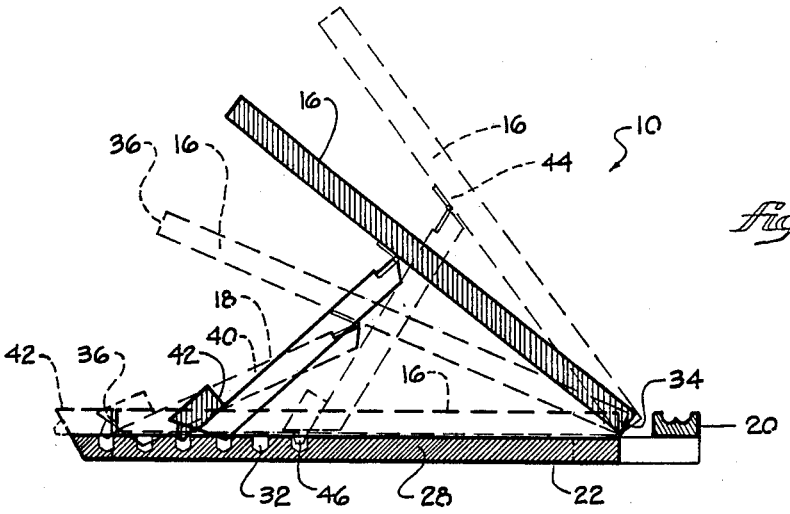
FIG. 4 is a side sectional view taken along line 4—4 in FIG. 2 illustrating various different inclined positions of the drawing board.

Referring now to the drawings, a first embodiment of the drawing table of the instant invention is illustrated in FIGS. 1, 2 and 4–6 and generally indicated at 10; and a second embodiment of the drawing table is illustrated in FIG. 3 and generally indicated at 12. The drawing tables 10 and 12 are adapted to be supported on substantially horizontal supporting surfaces so that they can be effectively utilized for performing various drafting operations. They are, however, also adapted to be positioned in collapsed positions wherein they can be effectively and easily transported.

The drawing table 10 comprises a frame generally indicated at 14, a drawing board 16, a drawing board support assembly generally indicated at 18, an instrument tray 20, and a pair of instrument tray mounting members 22.

As will be seen most clearly from FIG. 2, the frame 14 comprises spaced substantially parallel elongated front and rear frame members 24 and 26, respectively, and a pair of spaced side frame members 28 which extend between the front and rear frame members 24 and 26, respectively. The frame 14 further comprises a bottom wall member 30 which extends between the front and rear frame members 24 and 26, respectively, and the side frame members 28 and which cooperates with the frame members 24, 26 and 28 for defining a shallow substantially rectangular open box-like compartment in the table 10. Formed along the upper rear portions of each of the side frame members 28 are aligned spaced recesses or holes 32 which are positioned in corresponding spaced positions in the two side frame members 28.

The drawing board 16 preferably comprises a conventional substantially rectangular drawing board and it has substantially straight front and rear edges 34 and 36, respectively. The underside portion of the drawing board 16 which is adjacent to the front edge 34 is hingeably attached to the side frame members 28 adjacent the forward extremities thereof with hinges 38. Accordingly, the drawing board 16 is hingeably attached to the frame 14 so that it is positionable in a collapsed position wherein it overlies the front, rear, and side frame members 24, 26 and 28, respectively, in substantially parallel relation therewith. The drawing board 16 is, however, alternatively positionable in a plurality of different inclined positions wherein it is hinged upwardly so that it extends upwardly and rearwardly from the front frame member 24 to the rear edge 36.

The drawing board support assembly 18 comprises a pair of spaced substantially parallel support arms 40 and a cross member 42 which extends between the support arms 40. The support arms 40 are hingeably attached to the back side of the drawing board 16 at intermediate points in the rearward extent thereof adjacent opposite side extremities of the drawing board 16 with hinges 44. The cross member 42 is attached to the support arms 40 adjacent the unattached ends thereof, and pins 46 (illustrated in FIG. 4) are provided on the underside of the cross member 42 and positioned thereon so that they are receivable in the recesses 32. Accordingly, the support assembly 18 is hingeably attached to the drawing board 16, and the pins 46 are receivable in the recesses 32 for releasably maintaining the drawing board 16 in various different inclined positions with respect to the frame 14.

The instrument tray 20 comprises an elongated member which is preferably constructed from a suitable rigid material, such as wood or plastic, and it has a pair of substantially parallel rounded upwardly facing channels 48 formed therein for receiving drafting instruments and the like. The mounting arms 22 which are utilized for securing the instrument tray 20 to the forward portion of the frame 14 comprise rigid elongated members and they are attached to the outer side of the side frame members 28 so that they extend forwardly therefrom. The tray 20 is secured to the mounting members 22 so that it is positioned in substantially parallel forwardly spaced relation to the front edge 34 of the drawing board 16 and preferably also so that it is in substantially parallel forwardly spaced relation to the frame 14. Accordingly, an open area 50 is defined adjacent to and rearwardly of the tray 20 which enables a user of the drawing table 10 to effectively grasp the instrument tray 20 so that it can be utilized as a carrying handle. The instrument tray 20 is, however, preferably positioned close enough to the front edge 34 of the drawing board 16 so that it functions as a stop for retaining articles such as books, pads or the like on the drawing board 16 when the drawing board 16 is in an inclined position. The mounting members 22 are preferably further dimensioned and configured so that when the drawing board 16 is positioned in the collapsed position thereof, the support arms 40 are located in rearwardly aligned interfitting relation with the mounting members 22, whereby they cooperate with the support arms 40 to form substantially even side edges on the drawing table 10.

Figure 5:
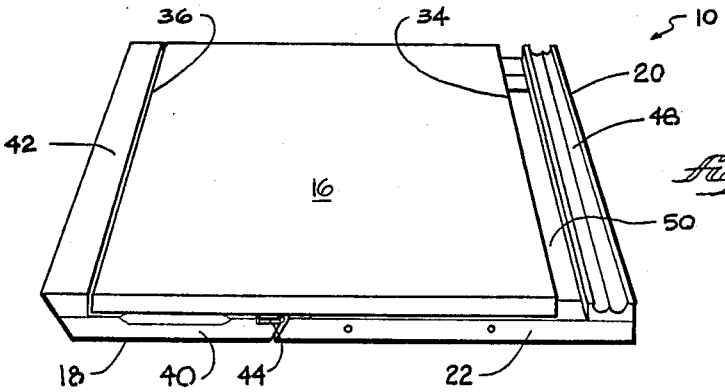
FIG. 5 is a perspective view of the drawing table in a collapsed position.
Figure 6:
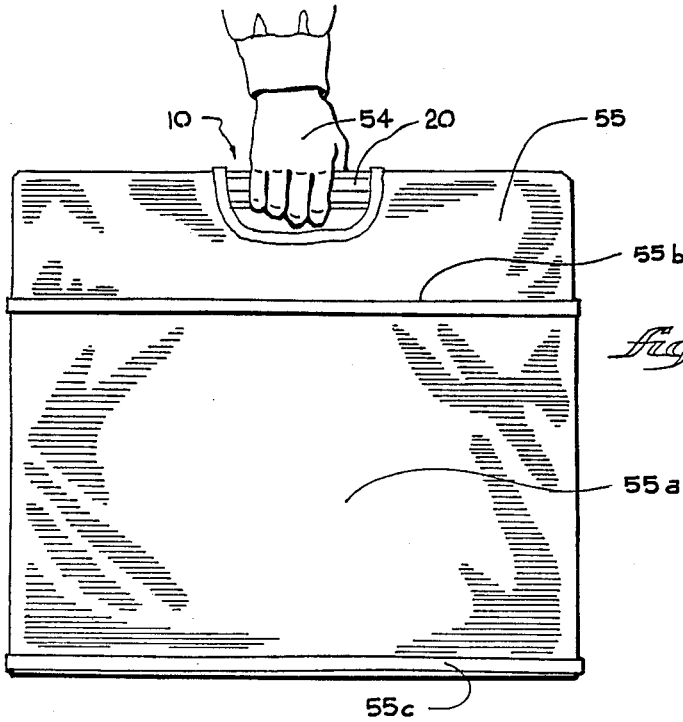
FIG. 6 is a side elevational view of the drawing table as it is transported in a carrying case.

For use and operation of the drawing table 10, the frame 14 is positioned on a supporting surface, and thereafter the drawing board 16 is hinged upwardly to an inclined position and releasably secured in the desired position with the support assembly 14 by positioning the pins 46 in the appropriate recesses 32. The drawing board 16 can then be effectively utilized for carrying out various drafting operations, and drafting instruments can be positioned in the instrument tray 20 as desired. In this connection, since the instrument tray 20 is attached to the frame 14 rather than to the drawing board 16, the instrument tray 20 remains in a horizontal position wherein the channels 48 face substantially upwardly when the drawing board 16 is hinged upwardly; and accordingly instruments can be effectively contained in the instrument tray 20 without falling therefrom when the drawing board 16 is repositioned. The compartment which is defined by the side frame members 28, the front and rear frame members 24 and 26, respectively, and the bottom wall 30 can be effectively utilized for containing instruments, such as the instrument 52, and supplies, such as the supplies 53. Further, when the drawing board 16 is returned to the collapsed position thereof as illustrated in FIG. 5, it provides an effective cover for the compartment which is formed in the frame 14. Still further, as will be seen from FIG. 5, when the drawing board 16 is positioned in the collapsed position thereof, the support arms 40 are disposed in rearwardly aligned relation with the support members 22, and the cross member 42 is positioned adjacent the rear edge 36 of the drawing board 16 to provide a neat and compact construction for the drawing table 10. In addition, as will be seen from FIGS. 5 and 6, when the drawing board 16 is in the collapsed position, the instrument tray 20 can be effectively utilized as a carrying handle for transporting the drawing table 10. Specifically, as illustrated in FIG. 6, since the instrument tray 20 is spaced forwardly from the forward edge 34 of the drawing board 16 and also forwardly from the frame 14, a person can effectively grasp the instrument tray 20 with a hand 54 so that the fingers on the hand 54 encircle the instrument tray 20. This enables the drawing table 10 to be simply and easily transported in a manner similar to a conventional suitcase or briefcase as illustrated.

Once the drawing table 10 has been positioned in the collapsed position thereof, it can also be effectively assembled in a protective fabric carrying case, such as the carrying case 55 illustrated in FIG. 6, to protect the drawing table 10 when it is transported. In this regard, the carrying case 55 is preferably constructed so that it is open at the bottom end thereof to enable it to be effectively installed over the drawing table 10 to the position illustrated in FIG. 6. Further, the carrying case 55 is preferably dimensioned and configured so that it fits snugly over the drawing table 10 to retain the drawing board 16 in covering relation over the compartment which is formed in the frame 14 in order that instruments and supplies positioned in the compartment are effectively contained therein. The carrying case 55 preferably also includes a side storage pocket 55*a* which is open along an upper edge seam 55*b* thereof for providing access to the pocket 55*a* and which is closed along a bottom edge seam 55*c* thereof located adjacent the open bottom end of the carrying case 55.

The drawing table 12, which is illustrated in FIG. 3, is similar in construction to the drawing table 10; and it includes a frame 56, a drawing board 16, a drawing board support assembly 58, an instrument tray 20 and a pair of instrument tray mounting members 22. The frame 56 comprises a substantially flat rectangular board having a plurality of aligned recesses 60 therein, and the drawing board 16 is hingeably attached to the frame 56 with hinges 38. The instrument tray support members 22 extend forwardly from opposite side edges of the frame 56 for mounting the instrument tray 20 in forwardly spaced relation thereto. The support assembly 58 is generally similar to the support assembly 18 in the drawing table 10, and it includes a pair of side support arms 40, which are hingeably attached to the drawing board 16 with hinges 44, and a cross member 42. The support assembly 58, however, only includes a single pin 46 which is positioned so that it is receivable in different recesses 60 for maintaining the drawing board 16 in various different inclined positions. The drawing table 12 is adapted to be effectively transported in a manner similar to the drawing table 10, although the frame 56 does not form a compartment for transporting instruments and supplies in the drawing table 12.

It is seen therefore that the instant invention provides an effective drawing table construction which is readily and easily transportable. The drawing tables 10 and 12 can be easily transported when they are in the collapsed positions thereof utilizing the instrument trays 20 thereof as carrying handles, and both of the tables 10 and 12 are adapted for neat and compact constructions. Further, the table 10 includes the frame 14 which forms a compartment for containing and transporting articles and supplies which can be used with the table 10. Accordingly, it is seen that the drawing tables 10 and 12 have significant advantages over the heretofore available drawing table constructions and that therefore the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A drawing table construction comprising:

(a) a frame including a front frame member and a pair of spaced, substantially parallel side frame members which extend rearwardly from said front frame member in substantially perpendicular relation thereto said side frame member each having inner and outer sides;

(b) a drawing board formed with a continuously extending, unperforated work surface and having front and rear edges, said drawing board being hingeably attached to said frame adjacent to said front frame member so that said front edge is in substantially parallel relation thereto and so that when said frame is positioned on a supporting surface, said drawing board is hingeable between a collapsed position wherein it overlies said frame in substantially parallel relation thereto and inclined position wherein it extends upwardly and rearwardly from said front frame member to said rear edge;

(c) means for releasably adjusting said drawing board in said inclined position;

(d) an elongated instrument tray having at least one longitudinally extending channel formed therein for receiving drawing instruments; and (e) a pair of spaced, substantially parallel mounting members rigidly fastened to said side frame members along said outer sides and extending forwardly therefrom, and said instrument tray being permanently secured thereto in substantially parallel, forwardly spaced relation to both said front edge and said front frame member, said mounting members and said instrument tray and one of either said front edge or said front frame member cooperating to define an elongated unobstructed opening that is disposed adjacent to and rearwardly of said instrument tray to enable a user of said drawing table to utilize said instrument tray as a carrying handle when said drawing table is in said collapsed position thereof by grasping said instrument tray so that a hand of said user fully encircles the latter.

2. In the drawing table construction of claim 1, said frame further characterized as defining a compartment for receiving articles therein, said drawing board further characterized as defining a cover for said compartment when said drawing board is in the collapsed position thereof.

3. In the drawing table of claim 2, said frame further comprising a rear frame member, said side frame members extending between said front and rear frame members, and a bottom panel which extends between said front and rear frame members and said side frame members and cooperates therewith to define said compartment.

4. In the drawing table construction of claim 3, said releasable adjustment means selectably engaging said side frame member to maintain said drawing board in said inclined position and to laterally secure said adjustment means in said inclined position.

5. The drawing table construction of claim 2 in combination with a carrying case, said carrying case being snugly receivable over said drawing table partially exposing said instrument tray for use as said carrying handle, and for retaining said drawing table in said collapsed position thereof, whereby instruments received in said compartment are effectively retained therein.

6. In the drawing table construction of claim 1, said releasable adjustment means further characterized as being adjustable for releasably maintaining said drawing board in a plurality of different inclined positions wherein it extends upwardly and rearwardly from said front frame member.

7. In the drawing table construction of claim 1, said releasable adjustment means being hingedly attached to said drawing board and being engageable with said frame for releasably maintaining said drawing board in said inclined positions.

8. In the drawing table construction of claim 1, said releasable adjusting means comprising a pair of support arms which are hingeably attached to said drawing board so they are positioned in rearwardly aligned relation to said forwardly extending mounting members and cooperate therewith to define side extremities of said drawing table when said drawing board is in the collapsed position thereof.

9. In the drawing table construction of claim 8, said side members including a plurality of spaced holes, said releasable adjustment means further comprising a cross member which extends between said support arms and is selectably engageable in said holes in said side frame members for supporting said drawing board in an inclined position.

10. A drawing table construction comprising:

(a) a frame including a front frame member and a pair of spaced, substantially parallel side frame members which extend rearwardly from said front frame member in substantially perpendicular relation thereto;

(b) a drawing board formed with a continuously extending, unperforated work surface and having front and rear edges, said drawing board being hingeably attached to said frame adjacent to said front frame member so that said front edge is in substantially parallel relation thereto and so that when said frame is positioned on a supporting surface, said drawing board is hingeable between a collapsed position wherein it overlies said frame in substantially parallel relation thereto and an inclined position wherein it extends upwardly and rearwardly from said front frame member to said rear edge;

(c) means for releasably adjusting said drawing board in said inclined position;

(d) an elongated instrument tray having at least one elongated longitudinally extending upwardly facing channel formed therein, said channel being dimensioned for receiving and positioning drawing instruments therein; and (e) a pair of spaced, substantially parallel mounting members rigidly fastened to said side frame members and extending forwardly therefrom, said instrument tray being permanently secured to said mounting members in substantially parallel, forwardly spaced relation to both said front edge and said front frame member, said mounting members and said instrument tray and one of either said front edge or said front frame member cooperating to define an elongated unobstructed opening that is disposed adjacent to and rearwardly of said instrument tray and extends between said mounting members to enable a user of said drawing table to utilize said instrument tray as a carrying handle when said drawing table is in said collapsed position thereof by grasping said instrument tray so that a hand of said user fully encircles the latter.

* * * * *